United States Patent [19]

Woodhouse

[11] Patent Number: 5,069,365

[45] Date of Patent: Dec. 3, 1991

[54] CHEMICAL DISPENSING SYSTEM

[76] Inventor: Robert C. Woodhouse, 3100 Hathaway, SE., Grand Rapids, Mich. 49506

[21] Appl. No.: 359,352

[22] Filed: May 31, 1989

[51] Int. Cl.[5] ..... B65D 35/56

[52] U.S. Cl. ..... 222/105; 222/327; 222/333

[58] Field of Search ..... 222/94, 101, 102, 105, 222/92, 98, 206. 214, 326, 327, 333, 182, 183

[56] References Cited

U.S. PATENT DOCUMENTS

| | | | |
|---|---|---|---|
| 1,924,195 | 8/1933 | Miles | 222/101 |
| 2,152,862 | 4/1939 | Bergerioux | 222/105 |
| 2,261,877 | 11/1941 | Erickson et al. | 222/101 |
| 2,903,161 | 9/1959 | Stahmer | 222/103 |
| 3,029,983 | 4/1962 | Wagenhals | 222/94 |
| 3,187,951 | 6/1965 | Hardman et al. | 222/102 |
| 3,239,105 | 3/1966 | Woodson | 222/94 |
| 3,323,682 | 6/1967 | Creighton. Jr. et al. | 222/94 |
| 3,481,510 | 12/1969 | Allen. Jr. | 222/327 |
| 4,125,206 | 11/1978 | Wilson | 222/101 |
| 4,291,799 | 9/1981 | Bowers. Jr. | 206/219 |
| 4,335,834 | 6/1982 | Zepkin | 222/333 |
| 4,440,317 | 4/1984 | Clark et al. | 222/105 |
| 4,570,827 | 2/1986 | Roggenburg. Jr. et al. | 222/105 |

FOREIGN PATENT DOCUMENTS

| | | | |
|---|---|---|---|
| 2351022 | 1/1978 | France | 222/101 |
| 2619321 | 12/1987 | France | 222/102 |

*Primary Examiner*—Joseph E. Valenza
*Assistant Examiner*—Kenneth Noland
*Attorney, Agent, or Firm*—Price, Heneveld, Cooper, DeWitt & Litton

[57] ABSTRACT

A power driven chemical dispensing and mixing system having an enclosure for supporting a pressure deformable package containing chemicals to be dispensed. A power driven roller compresses the package against a fixed lid to expel the chemical through an output nozzle. If more than one chemical is being dispensed, a mixing nozzle can be attached for delivering the mixed chemicals to a work site. A chemical dispensing package for use with the dispensing and mixing system is also disclosed.

5 Claims, 3 Drawing Sheets

CHEMICAL DISPENSING SYSTEM

BACKGROUND OF THE INVENTION

It is common practice when working at home with epoxy resin materials to use a sheet of aluminum foil as a base upon which measured amounts of resin and catalyst can be drawn out next to each other and then mixed prior to use. While this is fine for home use, it is obviously inappropriate for the large amounts of material used in commercial or industrial applications. For such applications, a convenient means must be provided for handling large quantities of the materials. In prior attempts to solve this problem, devices have been provided in which deformable tubes of the two components would be placed into a cartridge similar to a caulking gun. The ram in the caulking gun would then be advanced to extrude the two materials from the nozzle of the gun. Using this technique, it was very difficult to control the proportional mixing of the two materials. The more dense and larger volume material—the resin, would often overwhelm the package containing the catalyst forcing it to expel its contents prematurely followed by the resin. In that case, there would be no mixing of the two components and the necessary hardening would not take place.

In an attempt to overcome the above-mentioned problem, devices have been built in which a separate tube of resin and a separate tube of hardener would be placed in a holder with the closed flattened ends of the two tubes fixed between two rollers which would then be advanced to extrude the material from the two tubes. While this system prevented the larger resin tube from overwhelming the catalyst and did enable the two materials to be expelled in the correct proportions, it also created a substantial problem in that the catalyst was led through a fixed tube to a nozzle, and the resin was led in a similar manner through a fixed tube to a nozzle where the two materials would come together. Because of this construction, if the bonding process was going to be stopped for any period of time—for example, a period as short as a lunch break—the nozzle had to be carefully cleaned to prevent the resin from hardening in place destroying the usefulness of the gun. The latter systems also employed a complex system of worm gears, driving gears and rollers to extrude the material from the separate tubes.

SUMMARY OF THE INVENTION

In accordance with the present invention, an improved chemical dispensing system is provided for dispensing two or more materials which is simple in design and easy to use. The chemicals to be dispensed from the improved system are provided in a deformable package specifically adapted for use in the system.

The present invention relates to a chemical dispensing system having an enclosure for a package of chemicals which are to be dispensed. A nozzle is positioned on the front of the enclosure for dispensing the chemicals. A driven carriage carrying a roller is positioned in the enclosure and is adapted to move from the rear to the front of the enclosure. The enclosure also has a coupling means to which can be joined a driving means for the carriage. In use, a pressure deformable packet of materials is positioned in the enclosure. The lid of the enclosure is then closed and the driving means causes the carriage to move compressing the deformable package against the lid allowing the roller to slowly expel the contents of the package into a nozzle mounted on the front of the enclosure.

As the materials are simultaneously dispensed, they can be mixed before use through the use of a suitable nozzle. For mixing the two materials, a static mixing nozzle can be attached to the exit port of the housing so that the materials would be thoroughly mixed in their passage through the static mixing nozzle before they exit that nozzle for use. Special packages have also been designed for use with the chemical dispensing system for containing the chemicals to be dispensed.

DETAILED DESCRIPTION OF THE INVENTION

Figure 1:
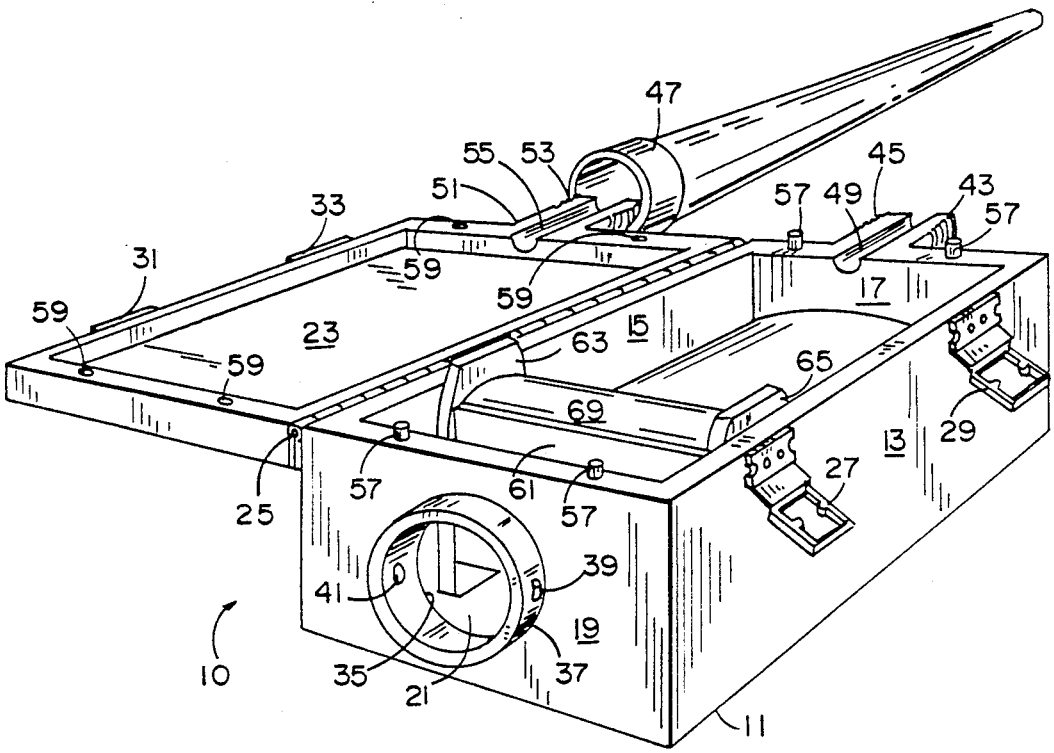
FIG. 1 is a perspective view showing the dispensing system with the lid open and with an attachable nozzle.

Referring to FIG. 1, the chemical dispenser is shown and indicated generally by the number 10. The dispenser is of a substantially rectangular box-like configuration having a lower portion 11 made of up elongated sides 13 and 15 which are joined to a front wall 17 and a rear wall 19. A bottom 21 joins the side, front, and rear walls into a completed shell. A lid 2 is pivotally attached adjacent to the top of side 15 by piano hinge 25. A pair of latches 27 and 29 are fastened adjacent to the top of side 13. Hook portions 31 and 33 are fastened to the edge of lid 23. When the top 23 is closed on the lower portion 11, the latch 27 cooperates with hook 31 while latch 29 cooperates with hook 33 to tightly lock lid 23 onto the lower portion 11. End wall 19 includes an aperture 35 which is bounded by a coupling 37 which is used to fasten an external power source to the dispenser. The coupling 37 has apertures 39 and 41 positioned across from each other on the circular coupling. The apertures 39 and 41 are used to affix the external power source to the dispenser 10. The apertures 39 and 41 can be threaded or plane surfaced.

The front wall 17 of the housing 11 has a portion of a nozzle 43 formed thereon. The outer surface of the nozzle portion 43 can be threaded or have ridges 45 for attachment of a disposable nozzle 47. The nozzle portion 43 also has a portion of a channel 49 formed therein.

Figure 5:
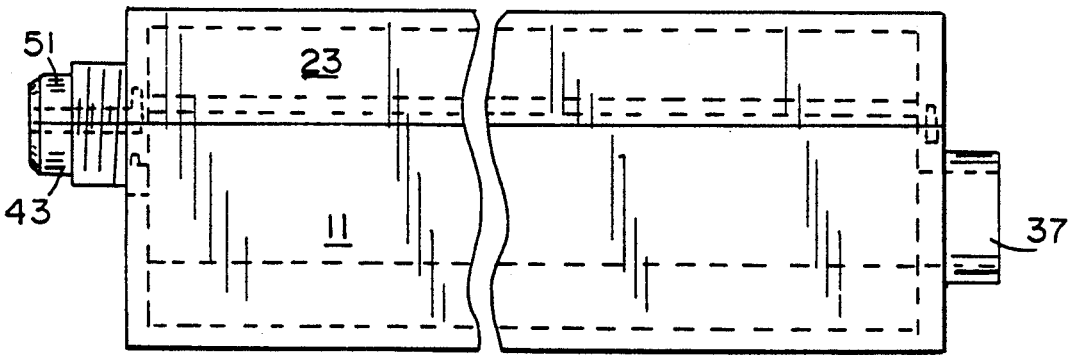
FIG. 5 is a plan view of the dispenser showing the exit nozzle completed.

The front portion of lid 43 has a portion of a nozzle 51 formed thereon. Like the nozzle portion 43, the nozzle portion 51 can be threaded or have ridges 53 on its outer surface for attachment of the disposable nozzle 47. The nozzle 51 has a portion of a channel 55 formed therein. When the lid of the chemical dispenser is closed as shown in FIG. 5, the nozzle portions 43 and 51 are joined together to form a complete nozzle or exit port for the chemical dispenser.

On the top portion of the front wall 17 and on the top portion of the rear wall 19 are mounted pairs of spaced pins 57. Similarly, on the front and rear portions of lid 23 are mounted pairs of apertures 59 for matingly receiving the pins 57.

Figure 3:
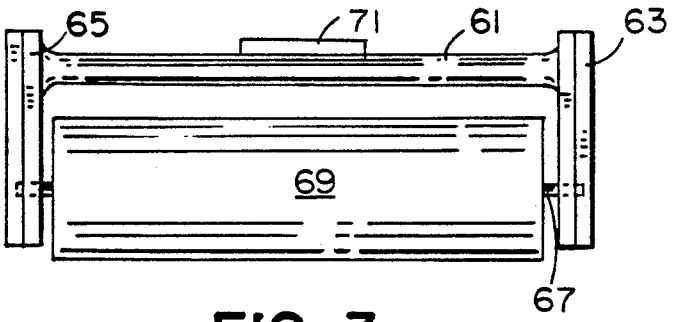
FIG. 3 is a top view of the carriage and roller assembly used in the dispenser of FIG. 1.

Referring to FIGS. 1 and 3, the housing 11 supports a carriage 61 having end pieces 63 and 65 for supporting an axle 67 upon which is mounted a roller 69. Substantially in the center of the carriage 61 is mounted a raised portion 71 which serves as a connecting surface for the external power source which drives the carriage 61.

Figure 4:
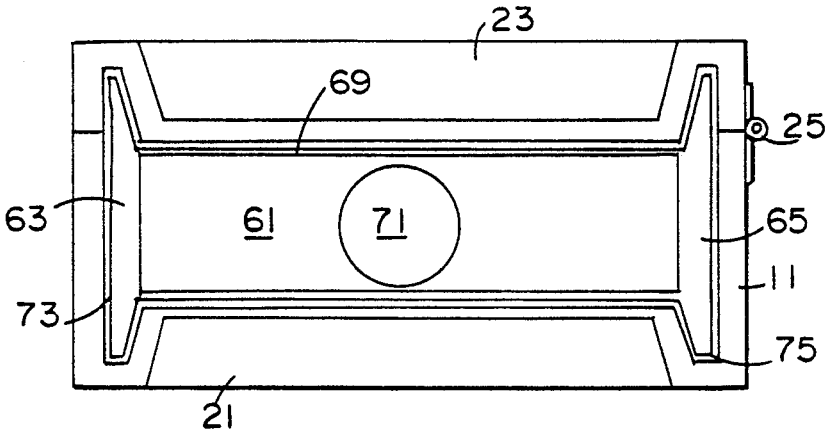
FIG. 4 is a sectional view of the dispenser with the lid closed.

As shown in FIG. 4, which represents the preferred embodiment of the present invention, when the lid 23 is closed on the housing 11, the end portions 63 and 65 of the carriage 61 are guided within channels 73 and 75 along each side of the interior of the dispenser housing. The center portions of the bottom 21 and lid 23 are raised and lowered, respectively, to assure the application of pressure by the roller 69 on the material to be dispensed. The surfaces 21 and 23 can be shaped as shown in FIG. 4 or they can also have smooth outer walls with the inner surface being raised by increasing the width or thickness of the material forming the housing.

Figure 2:
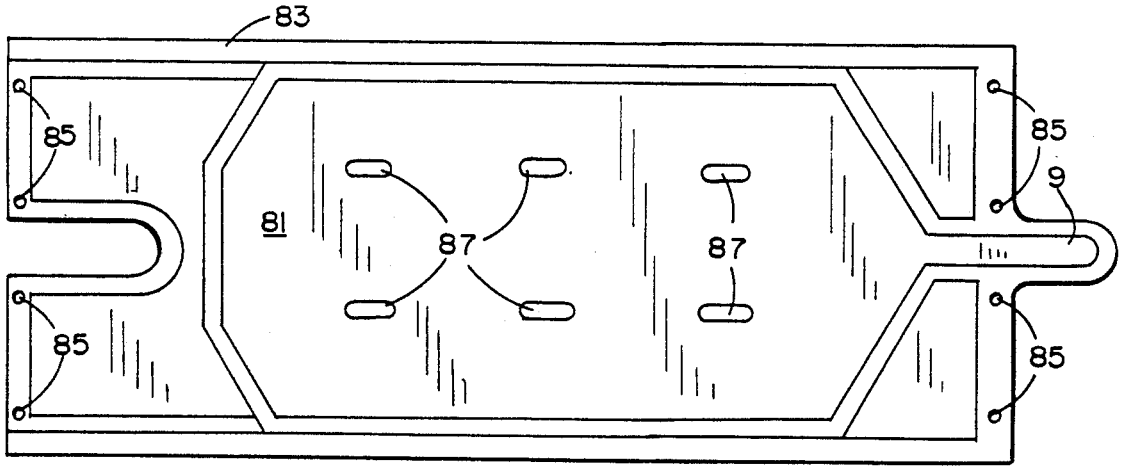
FIG. 2 is a plan view of a chemical dispensing package for use in the dispenser of FIG. 1.

The chemical dispenser is particularly useful in large industrial applications of epoxy-type glues or similar materials which require the proportioned dispensing of two or more materials. As shown in FIG. 2, the components of the glue, caulking or sealing materials or any other type materials are contained in deformable plastic pouches 81. Each component of the ultimate composition is contained in a separate plastic pouch which is sealed about the edges 83. Spaced apertures 85 are formed in each end of the pouch so that it can be suspended in the dispenser on the pins 57. The several layers forming the individual packets or containers of material are sealed together at spaced points 87 along the length of the packet. The sealing or binding points 87 prevent the contents of one of the pouches, usually the resin pouch, from overwhelming the contents of the smaller pouch and in turn causing the contents of the pouch to be expelled prematurely and not in the proper chemical proportion for the catalytic hardening of the composition.

Figure 6:
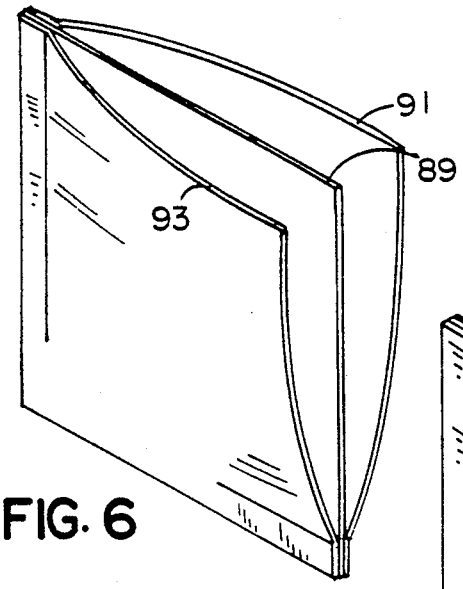
FIGS. 6, 7, and 8 show a partial view of the chemical dispensing package showing different means for proportioning the chemicals to be dispensed.
Figure 7:
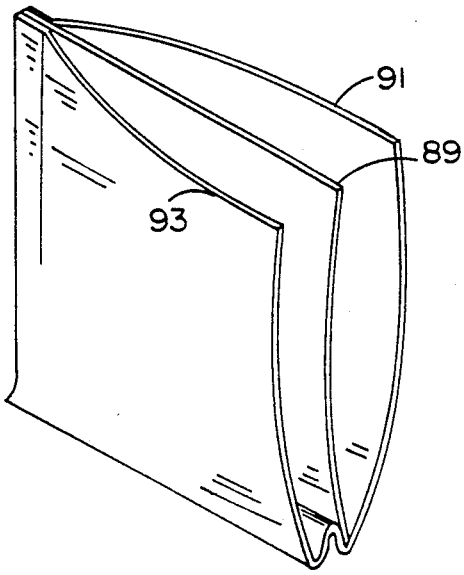
Figure 8:
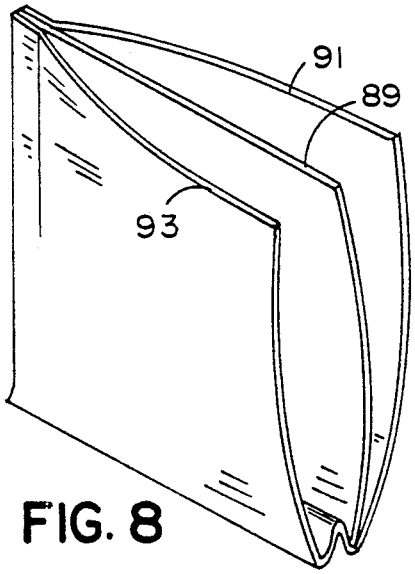

As shown in FIGS. 6, 7, and 8, the packets are formed with a common center wall 89 and outer walls 91 and 93. The packets of FIGS. 6 and 7 are meant to contain substantially equal amounts of each of the two components to be dispensed while the packet of FIG. 8 contains disproportionate amounts of the two materials. Since most two-component glues use substantially more resin than catalytic hardener, the packaging as shown in FIG. 8 will be the most common package used with the dispenser.

It is interesting to note that the packaging for the materials does not use a stiff center partition. Each of the outer walls and the inner common wall can be made of the same thickness of a compatible plastic film. Suitable films are polyethylene, Mylar, polyvinyl chloride, or other readily available plastic film materials. Obviously, the film selected has to be compatible with the chemical component system being packaged. Each of the individual packets containing the chemicals narrow to form an exit passageway 95. The passage 95 is sealed to maintain the separation of each of the components until they are ready for use.

In loading the chemical dispenser 10 with a packet of materials, the carriage 61 and in turn the roller 69 are moved to the rear wall 19 of the housing. The end of the packet opposite that having the exit passage 95 is mounted over the pins 57. The package is then stretched tautly and the front apertures 85 are also mounted on the pins 57. The end of the passageway 95 can then be cut off opening each one of the packets of chemicals. The lid 23 can then be closed and snapped tightly shut.

Since the dispenser will be expelling two or more components of the resin system, it is desirable for these components to be mixed before ultimate use. For this purpose, it is recommended that the nozzle 47 be a static mixing nozzle which has a tortuous path from the input to the output which causes the materials to thoroughly mix before exiting the nozzle. Static mixing nozzles are available from the Liquid Control Corporation of North Canton, Ohio, and from Chem-Mixx Technology of Bedford, Mass. The nozzles are disposable so there is no concern about cleaning. In a large application, fresh bags of chemical can be added to the dispenser and can be dispensed through a single nozzle. At the end of the job, the empty bags and nozzle can be disposed of. There is no need for the operator of the dispenser to come in contact with any of the chemical materials.

Figure 9:
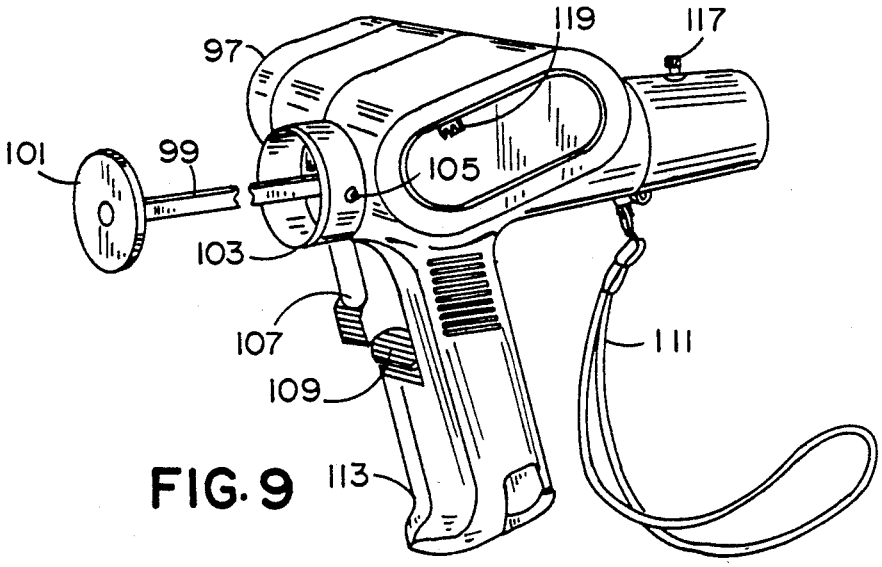
FIG. 9 is a perspective view of a representative power source for the dispenser.

The carriage in the chemical dispenser is moved by an external power source which is attached to the coupling 37 on the rear wall 19 of the dispenser. The power source can be a small alternating current electric motor or an air driven motor; however, each of these embodiments is complicated or made cumbersome by the need to provide a suitable electric cable or air line. The preferred power source is a battery-operated motor. As shown in FIG. 9, the power source 97 contains a reversible battery-operated motor for moving an extensible push rod 99 having a working surface 101 attached to the end thereof. The power source is fastened to the coupling 37 by sliding the collar 103 over the coupling 37 on the rear wall of the dispenser and then putting in place screws 105, only one of which is shown. When the power source is in position, the working surface 101 is in contact with surface 71 on the carriage 61. The power source has an on/off switch 107 and a lock 109 for the on/off switch to relieve the operator from stress from prolonged use of the power source. During use, the operator would slip the safety cord or strap 111 over his wrist and then grasp the hand grip 113 to actuate the trigger 107. A removable battery pack 115 fits within the grip 113. A variable speed control 117 is fastened above the motor of the power source and a remaining volume display 119 is mounted on the side of the power source. The volume display is mechanically linked to the push rod 99 so that there is a volume relationship between the movement of the push rod and the movement of the carriage and in turn the volume remaining in the pack 83 within the dispenser.

The preferred power source for the chemical dispenser is the model EZ581 Rechargeable Variable Speed Cordless Caulking Gun available from AEG Power Tools of Norwich, Conn. Similar external power sources available from other vendors can be substituted for the preferred power source shown. In using other power sources, changes may be necessary in the coupling 37 in order to adapt the chemical dispenser to a different coupling.

The chemical dispenser of the present invention provides an easy-to-use means for dispensing the multiple components making up a glue or caulking material. In using the dispenser, the operator merely inserts disposable bags of the chemicals without having any need to come into contact with the materials. A static mixing nozzle is used to thoroughly mix the materials so that the resin component will harden in the optimum amount of time. When the project is finished, the operator merely opens the dispenser, removes the packet of chemicals, and throws it away along with the static mixing nozzle. The dispenser is then ready for a new project or can be stored away for subsequent use.

Though the invention has been described with respect to a specific preferred embodiment thereof, many variations and modifications will immediately become apparent to those skilled in the art. It is therefore the intention that the appended claims will be interpreted as broadly as possible in view of the prior art to include all such variations and modifications.

The embodiments of the invention in which an exclusive property or privilege is claimed are defined as follows:

1. A chemical dispensing system comprising:

an enclosure having a bottom, opposed side, front, and rear walls and at least one upstanding pin on each of said front and rear walls and said lid has a mating aperture for each of said pins for tautly and stretchably supporting a bag of chemicals to be dispensed against said lid;

an opening defined in said rear wall for passage of a driving member;

a first part of a nozzle projecting from said front wall; a lid having a top, side, front, and rear walls coupled to said enclosure for movement between a first position closing said enclosure and a second position opening said enclosure;

a second part of a nozzle projecting from the front wall of said lid so that movement of said lid from the second position to the first position brings said first part of said nozzle into contact with the second part of said nozzle completing said nozzle;

a carriage slidably positioned in said enclosure for movement between said rear and front walls; and a roller on said carriage for squeezing a packet of chemicals against said lid thereby causing said chemicals to be dispensed through said nozzle when said carriage is moved by the driving member.

2. A chemical dispensing system as set forth in claim 1 wherein a packet of chemicals can be supported in said enclosure by said pins on said front and rear walls.

3. A chemical dispensing system as set forth in claim 2 wherein the top edge of said enclosure and the bottom edge of said lid are adapted to grip the edges of a packet of chemicals to be dispensed.

4. A chemical dispensing system as set forth in claim 2 wherein said mixing nozzle is a static mixing nozzle.

5. A package for containing chemicals to be dispensed from a powered chemical dispensing system comprising:

a supporting surface having a front and a rear edge and the same overall dimensions as an enclosure for said chemical dispensing system;

at least one pressure deformable container for holding a chemical to be dispensed disposed on said supporting surface;

at least one aperture in each of said front and rear edges of said supporting surface for coacting with pins in said chemical dispensing system and with apertures on ends of a surface of the enclosure to tautly and stretchably hold said supporting surface in place during operation of said chemical dispensing system;

a passageway for conveying the contents of said pressure deformable container to the output of said chemical dispensing system.

* * * * *